US006174082B1

(12) United States Patent
Pelky et al.

(10) Patent No.: US 6,174,082 B1
(45) Date of Patent: Jan. 16, 2001

(54) CHAIR-MOUNTABLE BAG

(76) Inventors: Miles A. Pelky, 1312 Second St., Coronado, CA (US) 92118; Mark E. Flanary, 576 Twin Oaks Ave., Chula Vista, CA (US) 91910

( * ) Notice: Under 35 U.S.C. 154(b), the term of this patent shall be extended for 0 days.

(21) Appl. No.: 09/357,418

(22) Filed: Jul. 20, 1999

Related U.S. Application Data

(60) Provisional application No. 60/125,391, filed on Mar. 22, 1999.

(51) Int. Cl.[7] ..... B65D 33/14

(52) U.S. Cl. ..... 383/22; 383/27; 383/40; 383/87; 383/106; 224/587; 150/114; D12/416

(58) Field of Search ..... 383/4, 22, 38, 383/39, 26, 27, 40, 106, 87; 224/275, 584; 150/114; D12/416

(56) References Cited

U.S. PATENT DOCUMENTS

| | | | |
|---|---|---|---|
| D. 308,916 | 7/1990 | Dinham | D12/416 X |
| D. 324,953 | 3/1992 | Swammer | D12/416 X |
| D. 371,108 | 6/1996 | Baker | D12/416 |
| 2,177,624 | 10/1939 | Marks | 150/114 X |
| 2,789,610 | 4/1957 | Pritchard | 383/87 X |
| 2,970,628 | 2/1961 | Tames | 383/87 X |
| 3,782,622 | 1/1974 | Montgomery | 383/27 X |
| 4,120,335 | 10/1978 | Mitchell | 383/87 X |
| 4,585,127 | 4/1986 | Benedict | 383/39 X |
| 4,949,401 | 8/1990 | Kimsey, Jr. | 383/4 X |
| 5,007,470 | 4/1991 | Freeman | 150/114 |
| 5,044,321 | 9/1991 | Selph | 224/275 X |
| 5,215,379 | 6/1993 | Pickard et al. | 383/106 X |
| 5,240,330 | 8/1993 | Thompson | 383/22 X |

FOREIGN PATENT DOCUMENTS

| | | | |
|---|---|---|---|
| 1 476 493 | 6/1977 | (GB) | 224/275 |

*Primary Examiner*—Jes F. Pascua
(74) *Attorney, Agent, or Firm*—Henri J. A. Charmasson; John D. Buchaca

(57) ABSTRACT

A portfolio for use by a participant to a convention, seminar or trade show can be conveniently secured over the back of a seat, provides a surface or transparent pocket for prominently displaying a corporate logo, trademark or association emblem, and has appropriately shaped and dimensioned pockets to hold documents, writing instruments and a cellular phone. The portfolio can be freely provided to such a participant as an advertising medium by installing it prior to the initial meeting over the back of the seat immediately in front of him.

11 Claims, 4 Drawing Sheets

CHAIR-MOUNTABLE BAG

PRIOR APPLICATION

This is a continuation-in-part of copending Provisional U.S. patent application Ser. No. 60/125,391 filed Mar. 22, 1999 from which priority is hereby claimed.

FIELD OF THE INVENTION

This invention relates to bags, caddies, portfolios and other document carriers, and more specifically, to temporary and disposable documents holders intended to be used at a special event.

BACKGROUND OF THE INVENTION

Participants to conventions, seminars, conferences or trade shows are routinely provided with advertising pamphlets, reference material, programs, outlines of lectures, and other documents. Many of those participants seldom carry appropriate means to hold those handouts in a organized and orderly manner. Unless they are sitting at a table or desk during a lecture, their handling of such documents can not only be cumbersome, but also constitute a noisy disturbance of the proceedings.

The organizers or sponsors of those types of meetings often seek recognition by providing folders and bags that prominently display their corporate logos, trademarks, or association emblems. However, those bags and folders can only endure an ephemeral use, and are soon discarded. The promotional message carried by those bags and folders have a short duration, and their early discarding not only constitutes waste of resources, but also add to the amount of trash that must be disposed of after such an event.

SUMMARY OF THE INVENTION

The principal and secondary objects of this invention are to address the aforesaid problems by providing a convenient and long-lasting document organizer that can also act as an effective advertising medium which can be conveniently and quietly used during a meeting, seminar, party, festival, concert, ballgame or other event, then optionally taken home by the participant as a gift or souvenir.

It is another object of the invention to provide a portable document or item organizer for service industries such as menu holders for restaurant.

These and other valuable objects are achieved by a portfolio having a display panel that can conveniently be secured over the back of the seat immediately in front of the user, and that has appropriately shaped and sized pockets to hold and provide easy access to documents writing instruments and other items without having to remove the portfolio from the back of the seat.

DESCRIPTION OF THE PREFERRED EMBODIMENT OF THE INVENTION

Figure 1:
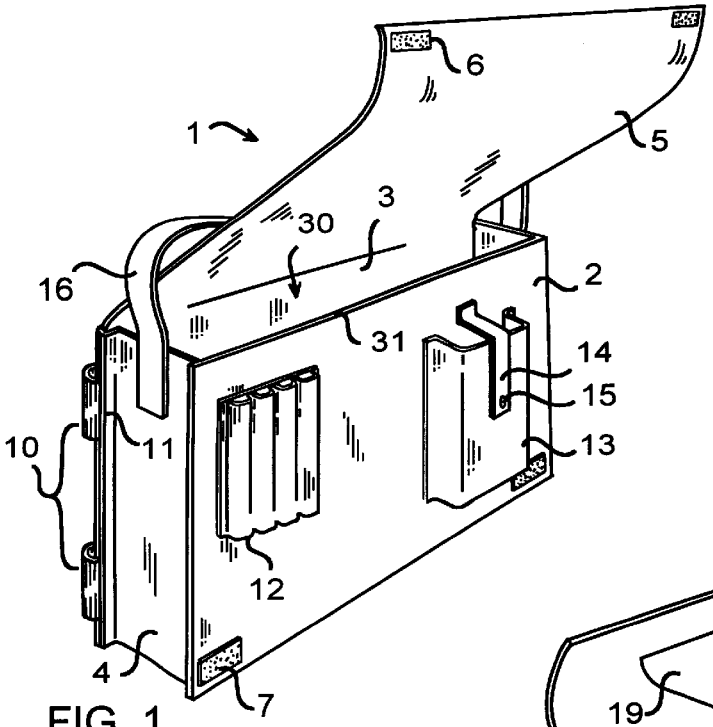
FIG. 1 is a front, top and right side perspective view of a portfolio according to the invention.
Figure 2:
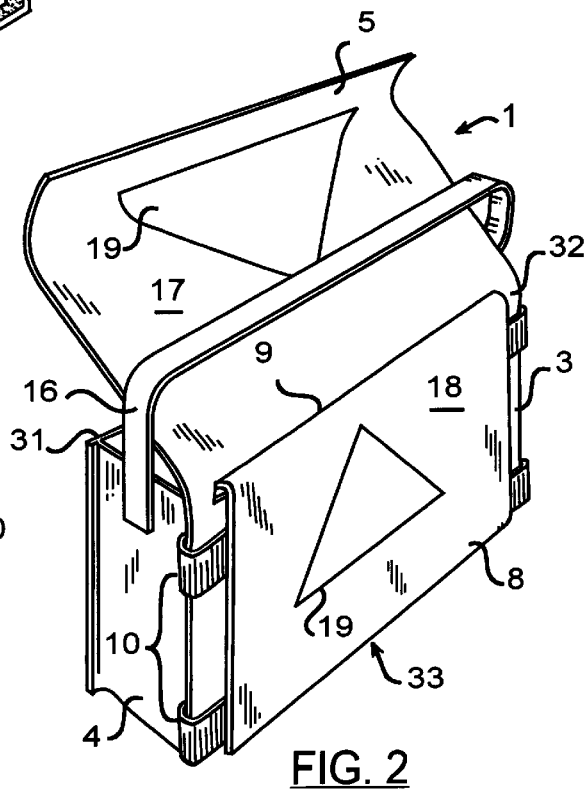
FIG. 2 is a back, top and left perspective view thereof.

Referring now to the drawing, there is shown a portfolio or document holder 1 having quadrangular and substantially symmetrical front panel 2 and back panel 3. The front and back panels are bridged over three sides by a bottom and lateral strip 4 to form a bag portion having a closed bottom and sidewalls defining an inner chamber 30 having an open top end and terminating at an upper periphery 31. A closing flap 5 having substantially the same width as the front and back panels extends from a portion of the periphery at the top edge of the back panel, over the open top of the portfolio and over the entire front panel, and is provided at its distal end with a fastener such as a clasp or one or more patches of a hook-and-vane type fabric fastener 6 that cooperates with a similar and cooperating implement 7 along the lower edge of the front panel. A quadrangular mounting flap 8 substantially symmetrical with the back panel 3 is secured along its top edge 9 to the top edge of the latter. A pair of resiliently stretchable straps 10 secures each lateral edge of the flap 8 to the near adjacent lateral edge 11 of the back panel on the outer surface 32 of the bag portion thereby forming an inverted mounting pocket 33 whose open end is located near the closed bottom of the bag portion, and whose closed end is located near the open top or upper periphery 31 of the bag portion.

Bonded or stitched to the front panel 2 is a pair of pocket structures 12 and 13. The first structure 12 is shaped and dimensioned to hold a plurality of writing instruments. More specifically, the pocket structure 12 is divided in a series of longitudinal channels open at the top to each receive a pen or pencil. The second pocket structure 13 is shaped and sized to conveniently hold a cellular phone or similar object. A securing strap 14 extends over the open top of that pocket structure and has a securing means 15 which may be similar to the one used in connection with the cover flap 5. A handle 16 made of pliable material spans the opposite upper end of the lateral and bottom strip 4. Accordingly, the handle 16 can either be inserted into the bag under the cover flap 5 or left to extend over the latter for use in carrying the portfolio. The front surface of the cover flap 17 as well as the exposed surface 18 of the back flap 8 can be used to display an informational card carrying a corporate logo, trademark, association emblem 19 or any other type of information.

Figure 3:
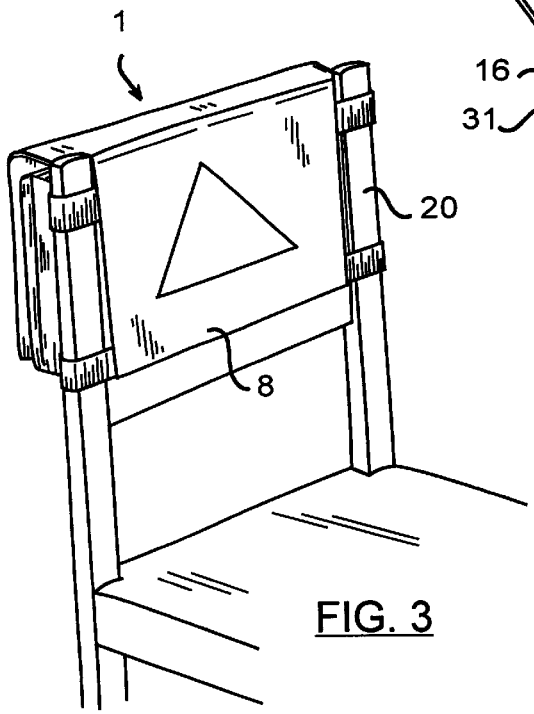
FIG. 3 is a perspective view of a portfolio installed over the back of a seat.

As illustrated in FIG. 3, the portfolio 1 can be conveniently attached to the back 20 of a seat. The resiliently stretchable straps 10 conveniently allow for enlargening of the mounting pocket and an increase in static friction between the portfolio and backrest providing secure attachment to a wide variety of seat-back shapes and dimensions. When so installed over the seats of a meeting room, bags, according to the invention, provide not only an attractive and eye-catching advertising display, but a convenient way for each participant or conventioneer to orderly hold and carry away a variety of documents and other implements.

Figure 4:
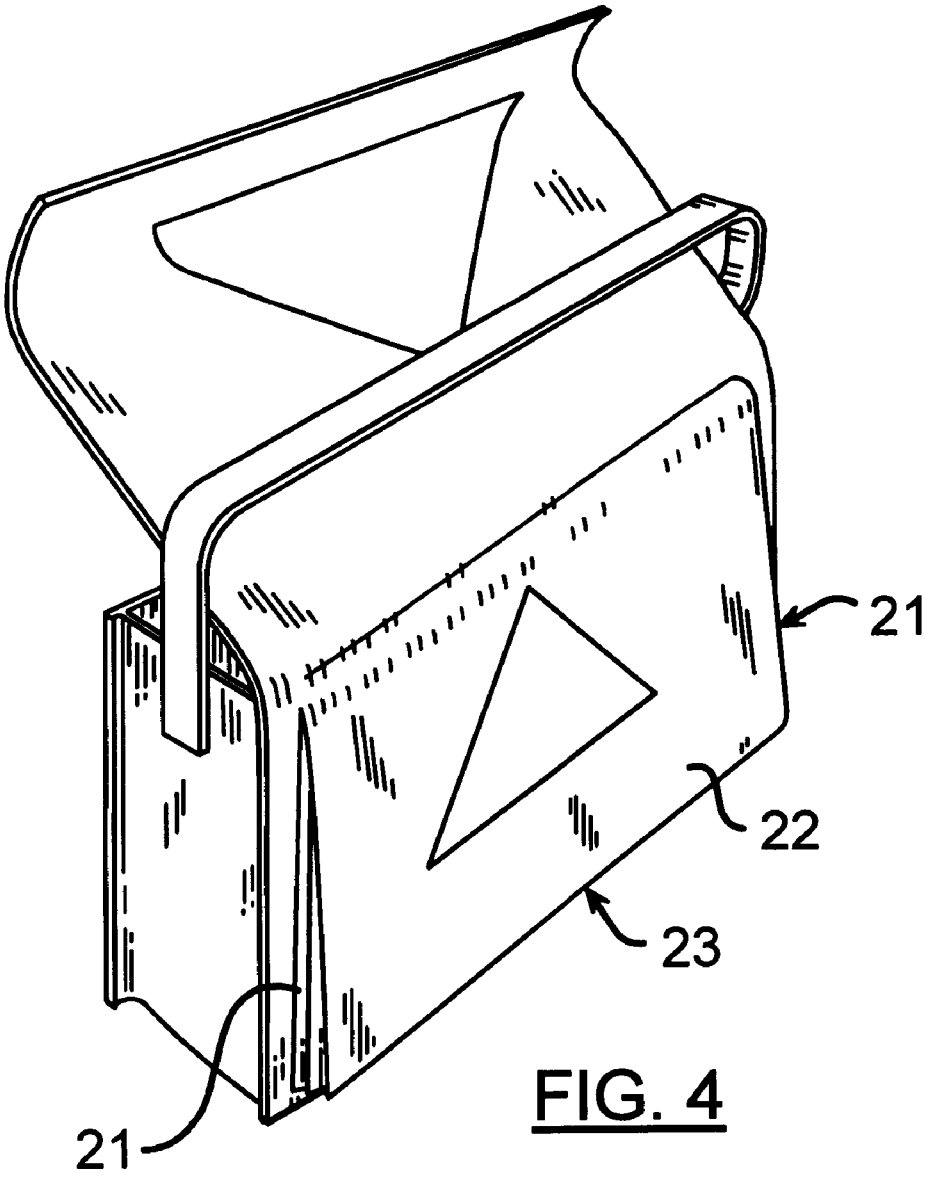
FIG. 4 is a perspective view of a portfolio according to an alternate embodiment of the invention.
Figure 7:
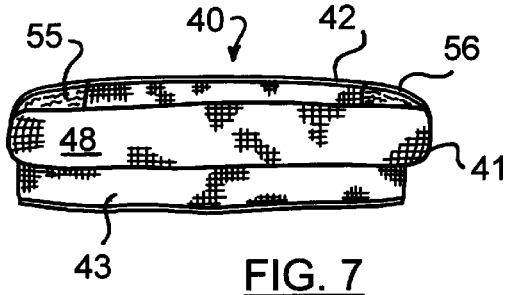
FIG. 7 is a generally bottom view of the portfolio of FIG. 5.
Figure 5:
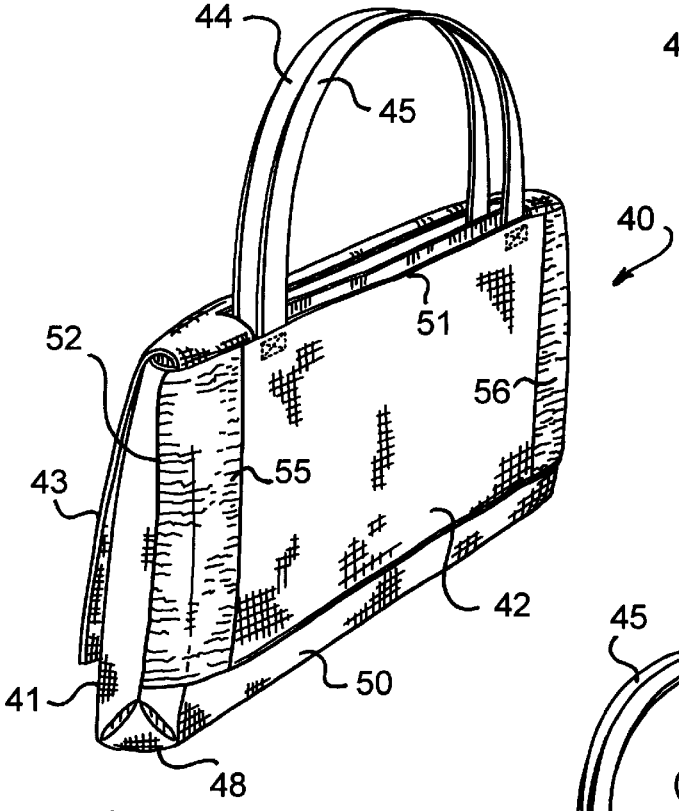
FIG. 5 is a generally back perspective view of a portfolio according to a second alternate embodiment of the invention.
Figure 6:
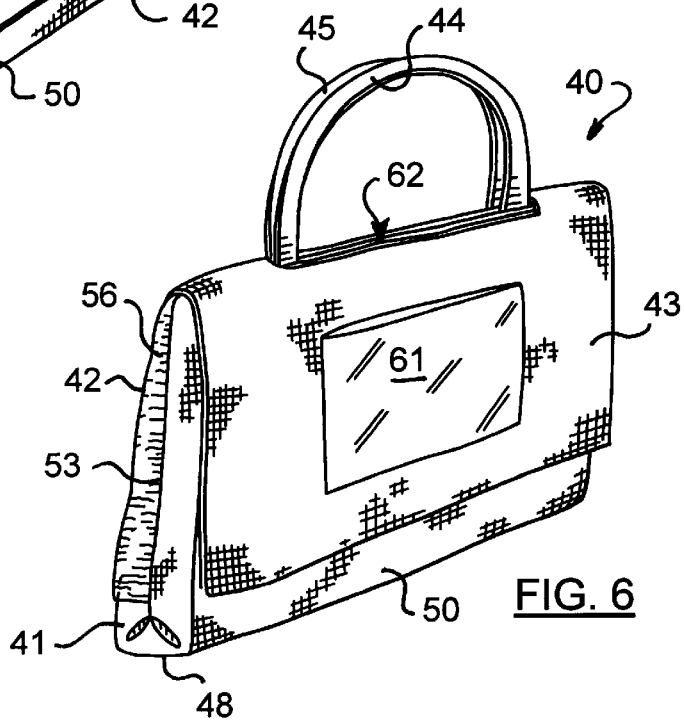
FIG. 6 is a generally front perspective view of the portfolio of FIG. 5.

Alternately, as shown in FIG. 4, the resiliently stretchable straps may be replaced by a continuous side webbing 21 which may be formed integrally with the back flap 22, thereby forming an inverted mounting pocket having a bottom opening 23 sized and shaped to slip over the backrest of a chair. Optionally, the side webbing may be laced with elastic material to accommodate backrests of various sizes and shapes.

The overall dimensions of the portfolio are approximately 38×27×5 centimeters (15×14×2 inches). The mounting pocket has a generally quadrangular shape and is sized to accommodate backrests of approximately 10×40 centimeters (4×16 inches) which allows the portfolio to be removably attached the most common convention hall chairs.

The portfolio is preferably made of a synthetic fabric such as nylon with heat-welded or stitched seams. Alternately, the portfolio may be made of cardboard or a strong grade of paper with bonded seams.

It should be understood that the shape, size and disposition of the documents, writing instruments, and cellular phone holding elements of the portfolio as well as the shape and size of the securing flap can be modified for adaptation to the holding and carrying of other types of implements, and for mounting to a variety of seat backs within the spirit and principle of the invention.

Alternately, as shown in FIGS. 5–8, a portfolio 40 is adapted to form a collapsible carrybag. The portfolio is made up of a bag portion 41, an inverted chair-mounting pocket portion 42, a cover flap 43, and a pair of handles 44,45.

The bag portion 41 is formed from one or more sheets of durable, lightweight, pliable sheet material such as nylon fabric stitched or otherwise bonded, to have an inner surface 49 and an outer surface 50, an upper periphery 47 surrounding an open top end, and a closed bottom end 48, thereby defining an inner chamber 46. In other words, a closed loop sidewall extends up from a closed bottom end.

Figure 8:
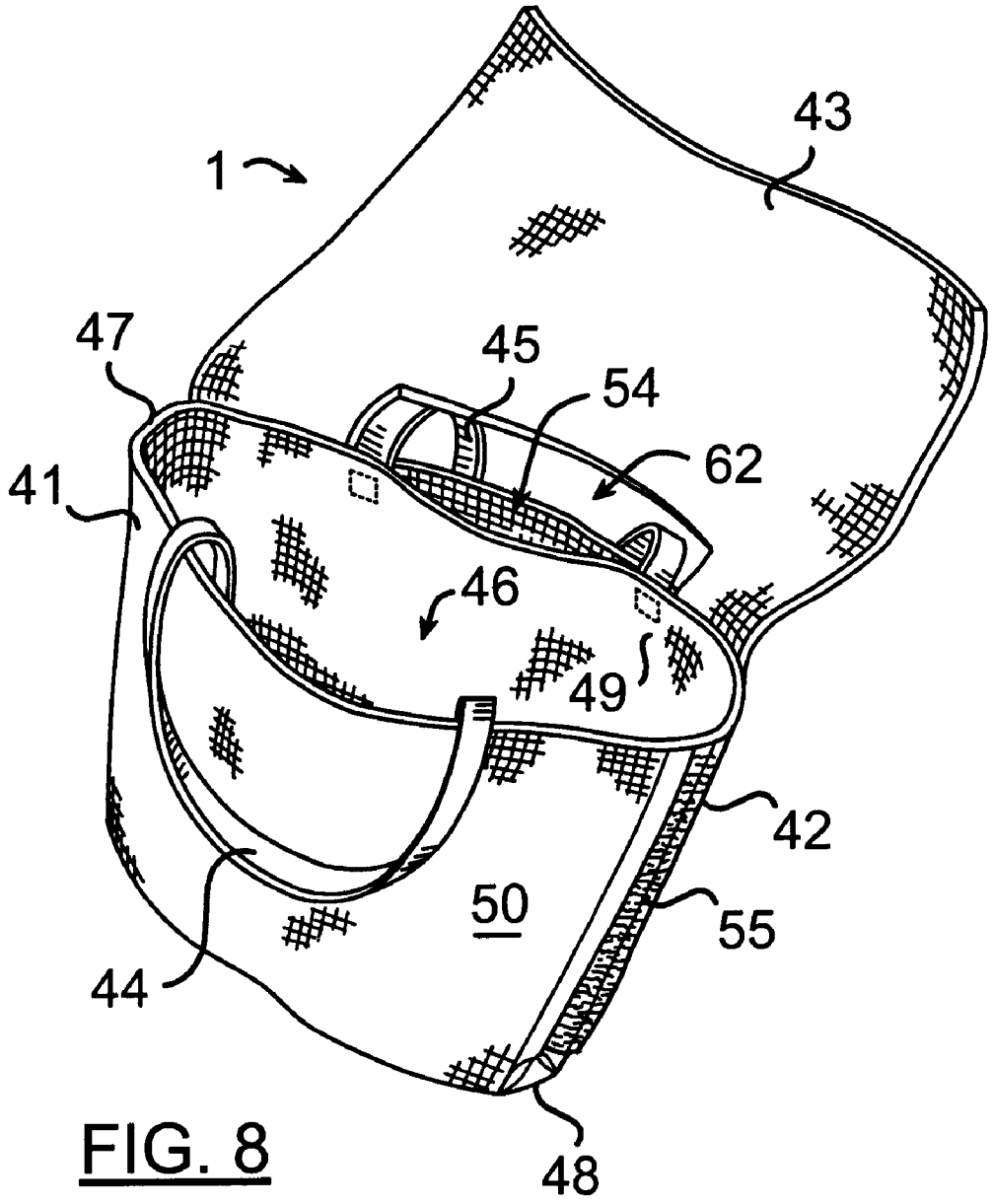
FIG. 8 is a generally front perspective view of the portfolio of FIG. 5 in an open bag configuration.

The chair-mounting pocket portion 42 is formed from a generally quadrangular panel of pliable sheet material bonded to the outer surface 50 of the bag portion along the top 51 and opposite lateral sides 52,53 to form an inverted pocket having a generally a generally closed upper end near the periphery 47 of the bag, and an open bottom end near the bottom of the bag 48. Elastic strips 55,56 are formed integral with the lateral edges of the panel and allow for a slight enlargening of the mounting pocket to both accommodate larger backrests and to more securely mount the portfolio to the backrest. As shown in FIG. 8, the upper end of the pocket need not be completely closed 54.

A cover flap 43 is a generally quadrangular panel of pliable sheet material attached along an edge to a portion of the periphery 47 of the bag. A display pocket 60 having a transparent outer window 61 is carried on the side of the flap which is exposed when the flap is in a bag-closed configuration as in FIGS. 5–7. As in the embodiments of FIGS. 1–4, the display pocket can carry an informational card for showing a corporate logo, trademark, association emblem or any other type of information. Preferably, the flap extends from the periphery on the same side of the bag as the mounting pocket 42 so that in its closed configuration the flap rests on the opposite side of the bag so that the display window 60 faces the seat behind the mounting chair. A second display pocket may be carried on the outer surface of the mounting pocket 42.

A pair of handles 44,45 extend from opposite sides of the periphery 47 of the bag portion 41 for carrying the portfolio. The flap 43 has an aperture 62 sized and positioned to allow passage of the handles therethrough when the flap is in a bag-closed configuration.

As with the embodiments of FIGS. 1–4, various utilitarian pocket structures may be bonded or stitched to the inner or outer surfaces of the bag portion, flap or even the mounting pocket for carrying or organizing pens, pencils, calculators, pagers, portable phones or other personal items.

While the preferred embodiments of the invention have been described, modifications can be made and other embodiments may be devised without departing from the spirit of the invention and the scope of the appended claims.

We claim:

1. A portfolio comprising:

a bag portion made from bonded sheet material which comprises:
an upper periphery defining an open top end;
a closed bottom end; and
an outer surface;

a mounting pocket located upon said outer surface, said pocket having an open bottom end and a closed top end;

wherein said mounting pocket is sized and shaped to fit over a backrest of a chair wherein said portfolio further comprises a flap extending from said periphery;

wherein said portfolio further comprises a first handle extending from said periphery; and wherein said flap is shaped to have a first aperture through said flap, said aperture being located proximate to said periphery and positioned to allow passage of said handle therethrough.

2. The portfolio of claim 1, wherein said mounting pocket comprises elastic material for allowing an enlargening of said open bottom end.

3. The portfolio of claim 1, wherein said bag portion and said mounting pocket are formed from pliable sheet material thereby enhancing a collapsibility of said portfolio.

4. The portfolio of claim 1, wherein said portfolio further comprises a display portion for carrying an informational card.

5. The portfolio of claim 4, wherein said display portion comprises a display pocket having a transparent outer panel.

6. The portfolio of claim 5, wherein said display pocket is located on the outer side of said flap when said flap is in a closed configuration.

7. The portfolio of claim 1, wherein said mounting pocket is sized and shaped to fit over a backrest having a width no greater than about 40 centimeters.

8. A portfolio comprising:

a bag portion made from bonded sheet material which comprises:
an upper periphery defining an open top end;
a closed bottom end; and
an outer surface;

a mounting pocket located upon said outer surface, said pocket having an open bottom end and a closed top end;

wherein said mounting pocket is sized and shaped to fit over a backrest of a chair;

wherein said portfolio further comprises a flap extending from said periphery; and wherein said flap has an outer surface having a display pocket positioned thereon, said display pocket having a substantially transparent outer panel sized and shaped to accept an information carrying card therein.

9. The portfolio of claim 8, wherein said mounting pocket comprises elastic material for allowing an enlargening of said open bottom end.

10. The portfolio of claim 8, wherein said bag portion and said mounting pocket are formed from pliable sheet material thereby enhancing a collapsibility of said portfolio.

11. The portfolio of claim 8, wherein said mounting pocket is sized and shaped to fit over a backrest having a width no greater than about 40 centimeters.

* * * * *